US008662378B2

(12) United States Patent
Mehta

(10) Patent No.: US 8,662,378 B2
(45) Date of Patent: Mar. 4, 2014

(54) VENTILATION BOARD, VENTILATION BOX, VENTILATION SYSTEM, INSULATING BOARD AND METHOD FOR MANUFACTURING VENTILATION BOARD AND BOX

(76) Inventor: Vinay K. Mehta, Mumbai (IN)

( * ) Notice: Subject to any disclaimer, the term of this patent is extended or adjusted under 35 U.S.C. 154(b) by 308 days.

(21) Appl. No.: 11/884,821

(22) PCT Filed: Jun. 7, 2005

(86) PCT No.: PCT/IN2005/000184

§ 371 (c)(1),
(2), (4) Date: Aug. 21, 2007

(87) PCT Pub. No.: WO2006/087731

PCT Pub. Date: Aug. 24, 2006

(65) Prior Publication Data

US 2010/0155460 A1 Jun. 24, 2010

(30) Foreign Application Priority Data

Feb. 21, 2005 (IN) ..... 187/MUM/2005

(51) Int. Cl.

| | |
|---|---|
| ***B65D 81/38*** | (2006.01) |
| ***B65D 5/42*** | (2006.01) |
| ***B31B 49/00*** | (2006.01) |

(52) U.S. Cl.
USPC ..... 229/103.11; 229/120; 493/344

(58) Field of Classification Search
USPC ..... 229/103.11, 120, 403, 902, 906
See application file for complete search history.

(56) References Cited

U.S. PATENT DOCUMENTS

| | | | | |
|---|---|---|---|---|
| 1,733,566 | A * | 10/1929 | Weaver | 229/120.1 |
| 2,533,773 | A * | 12/1950 | De La Foret | 229/120 |
| 3,523,058 | A * | 8/1970 | Shick | 428/182 |
| 7,387,231 | B2 * | 6/2008 | Yandian et al. | 229/122.34 |
| 2002/0079357 | A1 * | 6/2002 | Tulkoff | 229/120.32 |

* cited by examiner

*Primary Examiner* — Gary Elkins
*Assistant Examiner* — Christopher Demeree
(74) *Attorney, Agent, or Firm* — Minisandram Law Firm; Raghunath S. Minisandram

(57) ABSTRACT

The present invention relates to a ventilation board, an insulating board, a ventilation system, and articles and architectural applications comprising said ventilation board and a method of manufacturing the ventilation board. The said ventilation board comprises a layer (11) provided with a first aperture (5); an adjacent layer provided (13) with a second aperture (7), the first and second apertures being located relative to each other such that they are non-aligned and are substantially without overlap; and a passageway (9) interconnecting the first and second apertures thereby permitting the passage of fluid therebetween. Therefore, the carton comprising said ventilation board when used for fast food packaging provides sufficient ventilation of the carton so that water condensed from food vapors does not run on to the food in the carton, and sufficient insulation so that the food in the carton is kept warm.

34 Claims, 14 Drawing Sheets

Fig.1
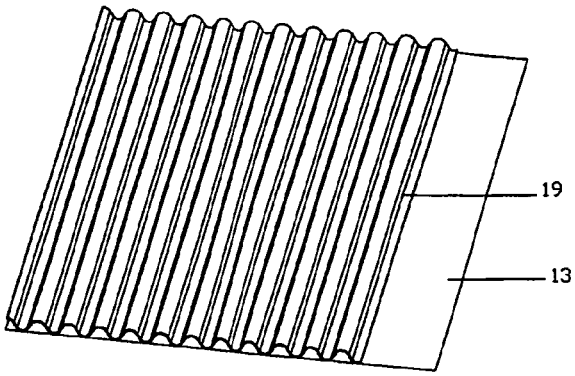
Fig.1A
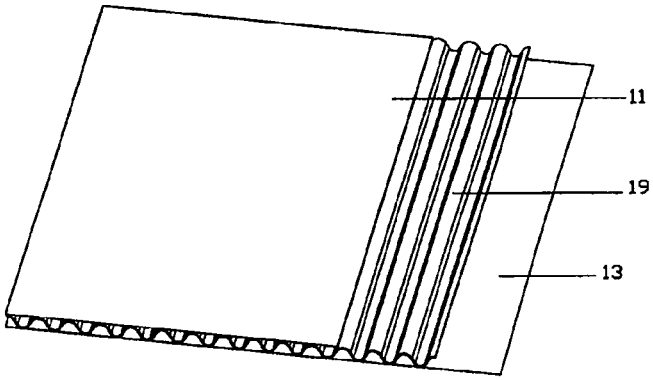
Fig.1B
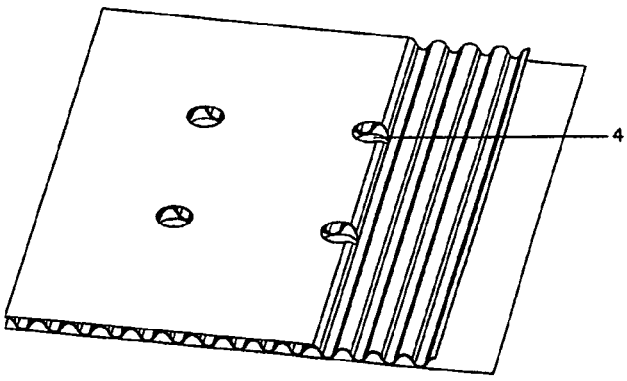
Fig.1C

Fig.2
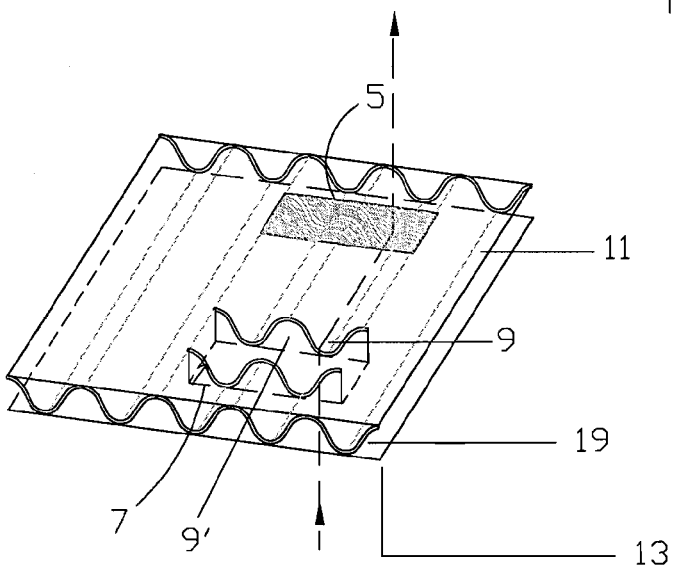
Fig.2A
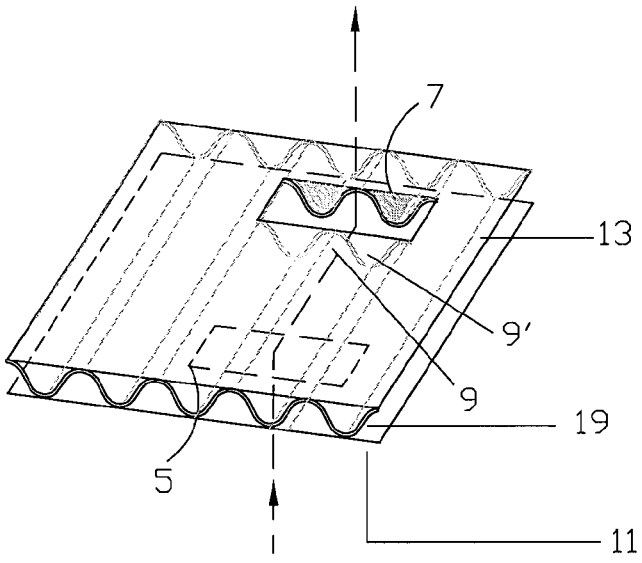
Fig.2B

Fig.3
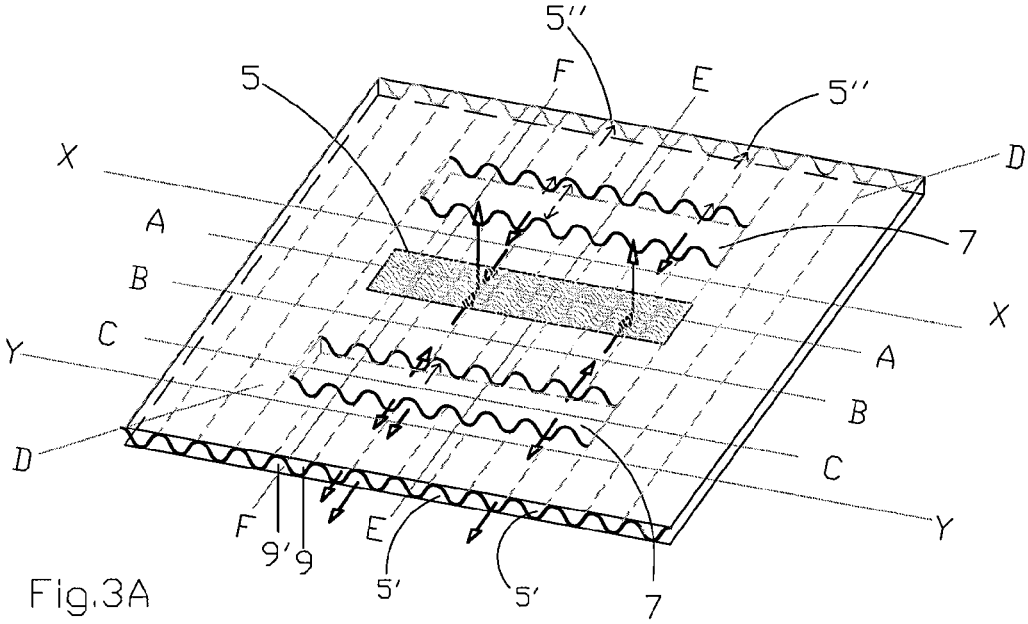
Fig.3A
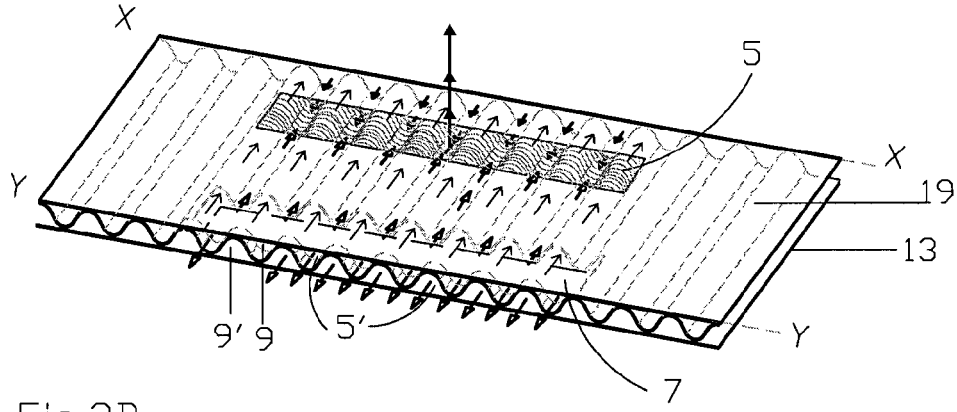
Fig.3B

Fig.5
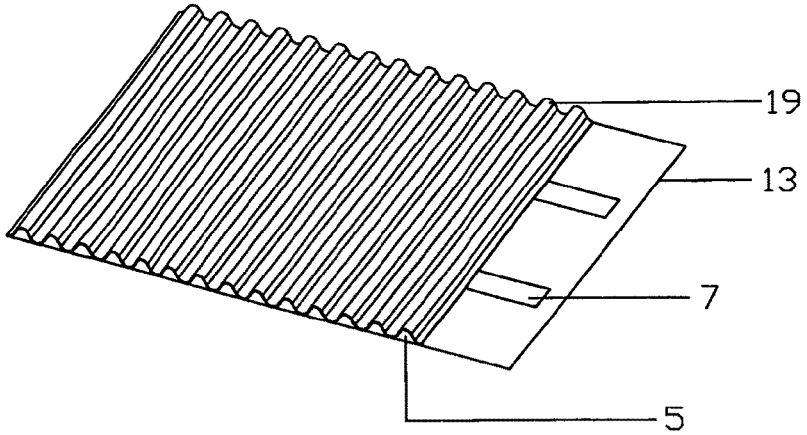
Fig.5A
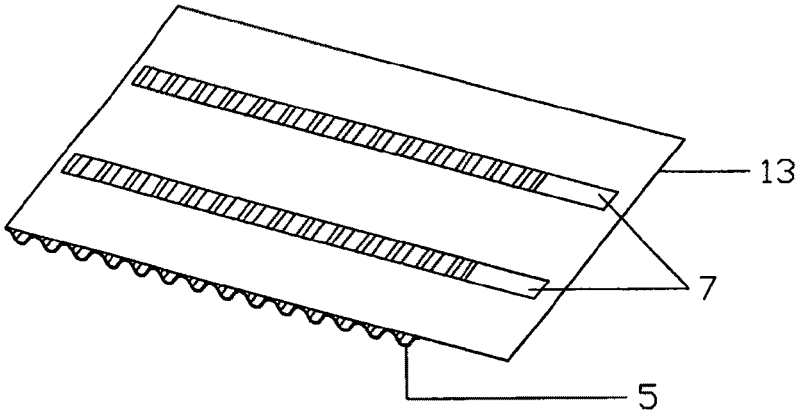
Fig.5B
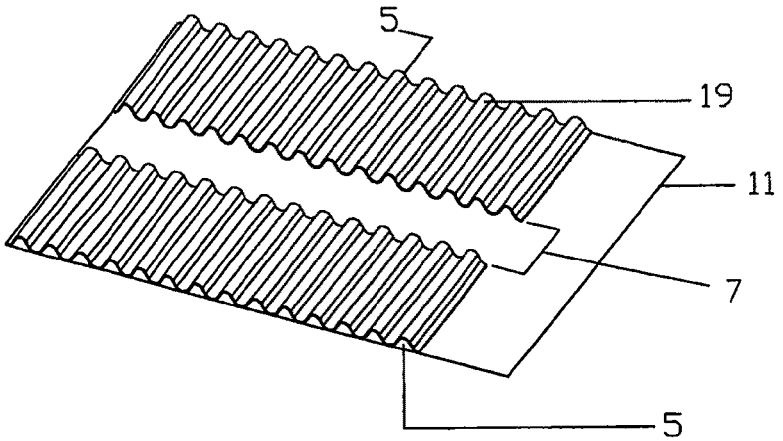
Fig.5C

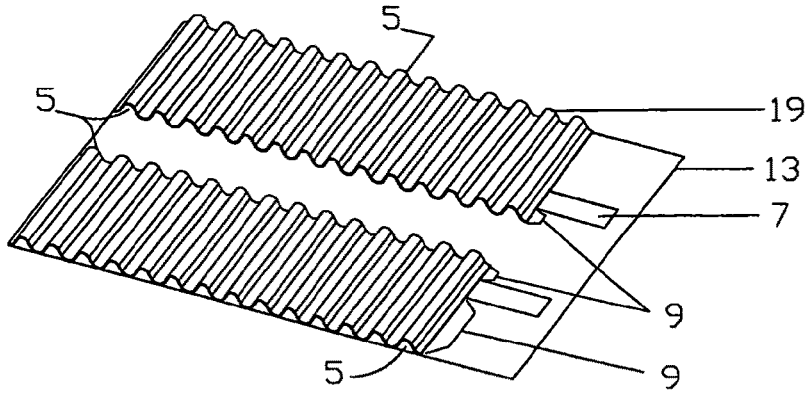
Fig.5D
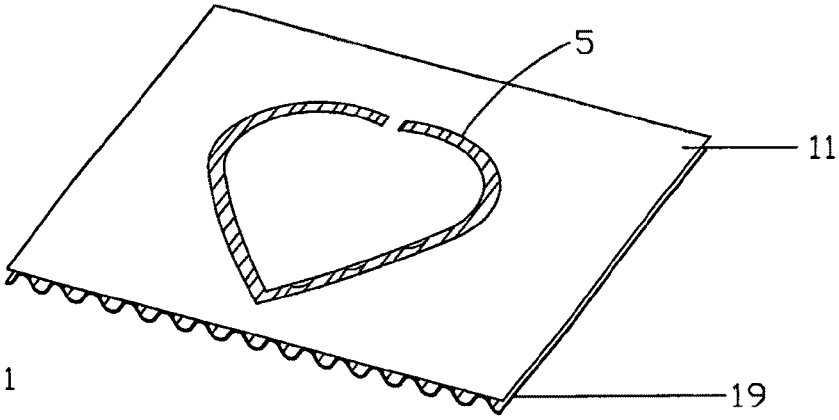
Fig.5E1
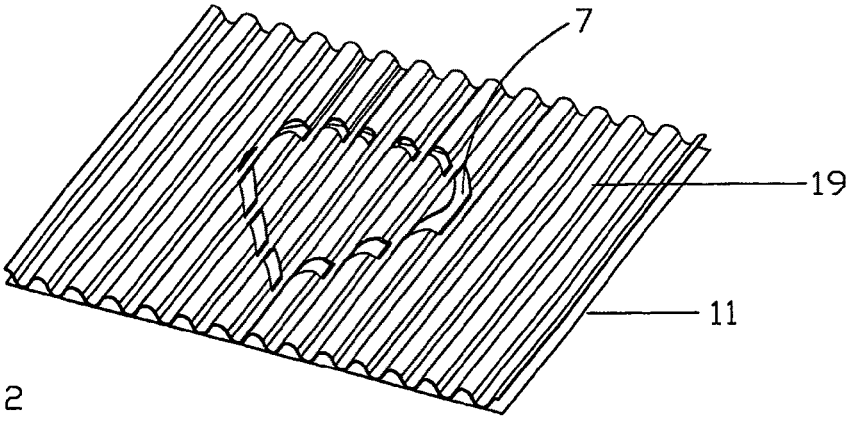
Fig.5E2

Fig.6
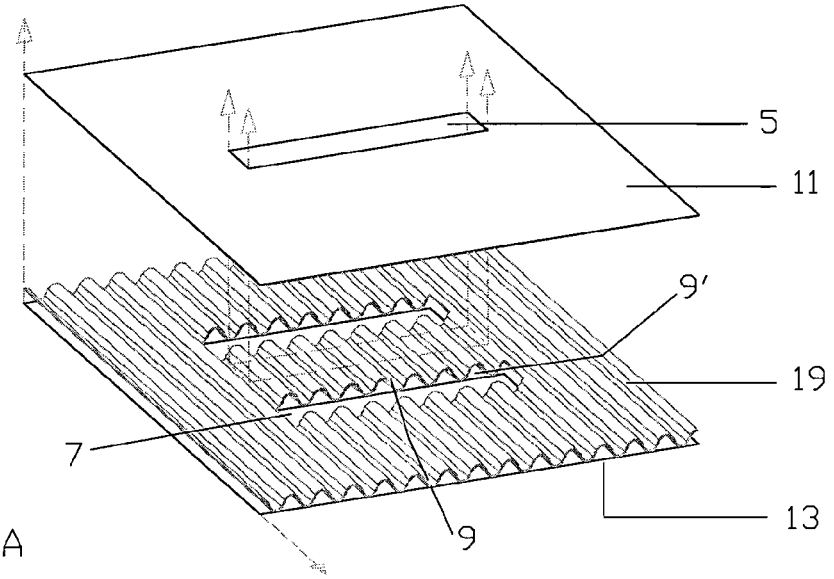
Fig.6A
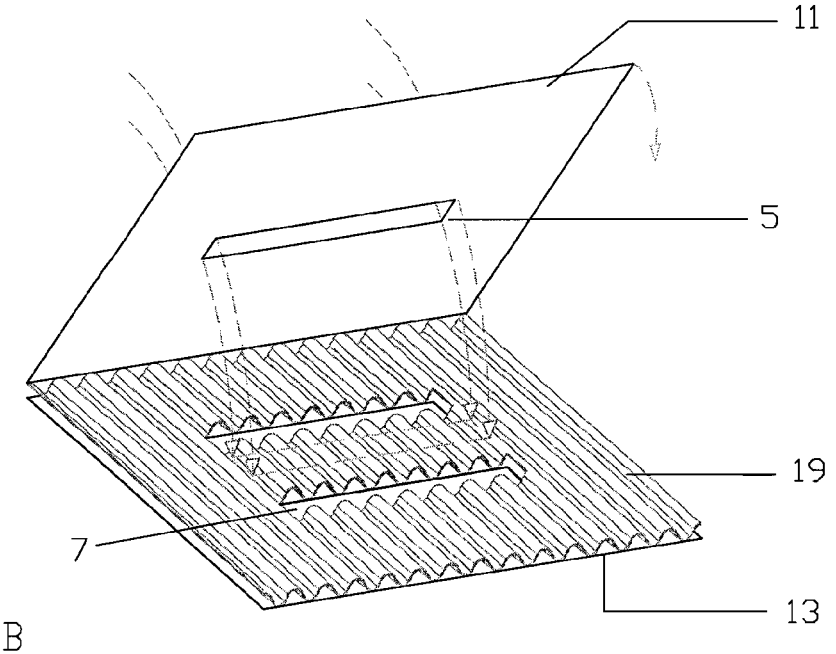
Fig.6B

Fig.7
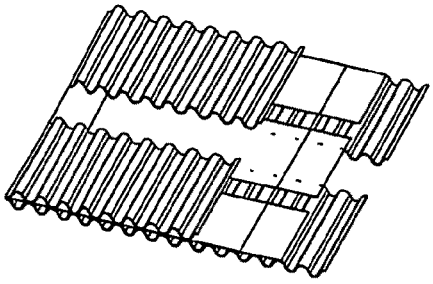
Fig.7A
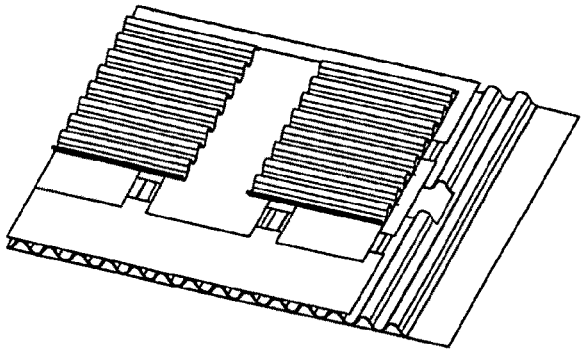
Fig.7B
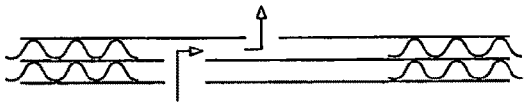
Fig.7C
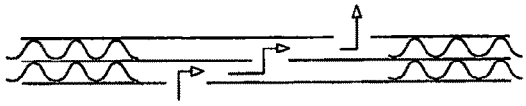
FIG.7D
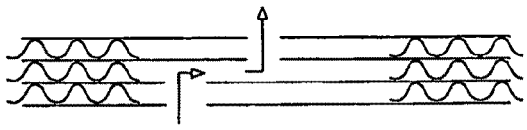
FIG.7E
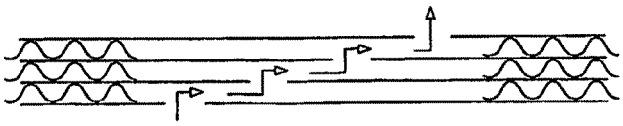
FIG.7F Fig.8
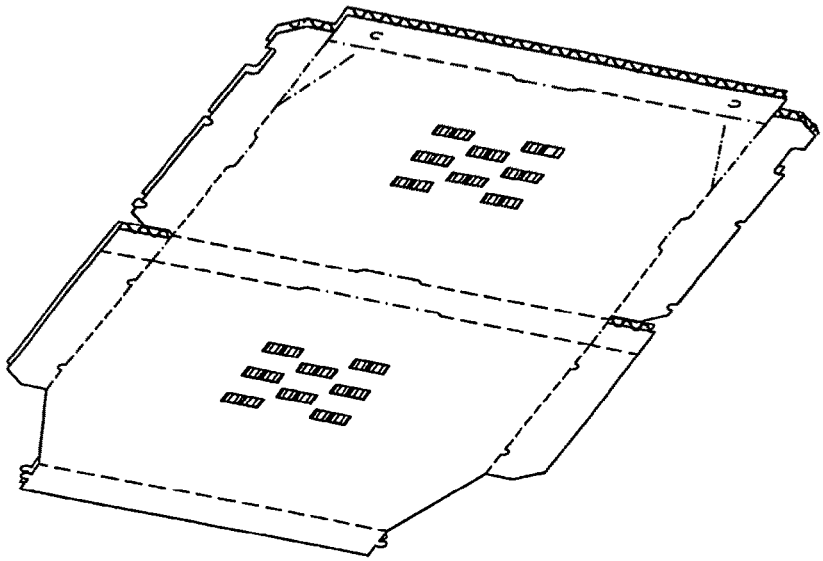
Fig.8A
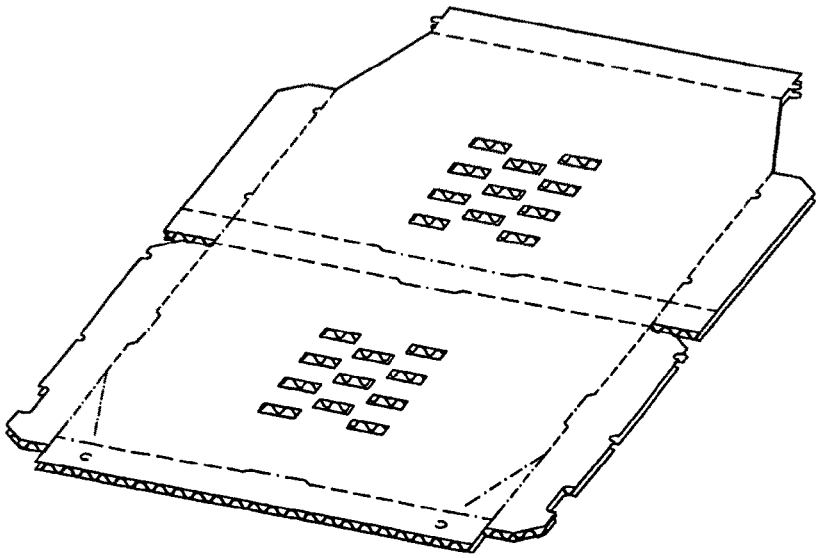
Fig.8B

VENTILATION BOARD, VENTILATION BOX, VENTILATION SYSTEM, INSULATING BOARD AND METHOD FOR MANUFACTURING VENTILATION BOARD AND BOX

FIELD OF THE INVENTION

The present invention relates to a ventilation board that has uses in various applications, including fast food packaging, particularly take-away pizza packaging; to a box comprising panels made of the board; to a ventilation system; and to a method of manufacturing a ventilation board.

BACKGROUND ART OF THE INVENTION

Ventilation is required in panels used for making boxes, drums, cans, containers, cases, pallets, crates, shipping containers etc. Many of these applications are used for storage purposes where, commonly, ventilation or insulation or both are important considerations. Both of these considerations are important in designing fast food packaging.

Fast food packaging has three aims. The packaging, such as a carton or other sort of box, should retain the heat of the food it contains, it should prevent the food from becoming soggy as the result of steam condensing into water on the inner surface of the carton, and also should be cost effective, as the packaging is usually disposable.

Generally, packaging that is widely used at present achieves the last aim with only one of the first two aims. It has been difficult to create packaging, which meets all three objectives simultaneously.

Known packaging fails to meet all of these three aims partly because of the following reasons. As the packaging, and the food within it, are transported, heat from the food and packaging disperses and steam is released into the atmosphere within the packaging. The packaging is cooler than the food. As the heated steam from the food rises vertically above the food, it rises towards the lid, or covering, of the packaging. On contact with the lid, the steam condenses into water on the lid transferring heat to the packaging. The condensed water is then free to fall back on to the food making it soggy and reducing its taste.

Cartons made of Styrofoam attempt to overcome this problem by retaining the heat within the carton, as Styrofoam is a highly insulative material. However, after time, heat still escapes from the carton, so that condensation forms within the carton above the food.

Another carton that is well known is made of corrugated paperboard. Corrugated paperboard is used to make the carton because of properties inherent in its corrugated structure. The inherent corrugated structure imparts resistance to, and distribution of, forces applied parallel to and perpendicular to the corrugations of the corrugated structure. When a force is applied in the direction of the flutes in the corrugated structure, the flutes are in compression, and, acting like columns, thereby resist the compression force. The corrugated structure therefore improves the compression strength of the board. When the force is applied perpendicular to the direction of the flutes of the corrugated structure, the flutes deform, absorbing the energy of the impacting force and distributing the force through the board. Thus, the corrugated structure improves the strength of the board by providing resistance to the applied force.

Where multilayer corrugated board is used, the layers of the board are generally used with their flutes parallel to the flutes of the adjacent layers. Thus, in a multilayer board it is possible to withstand compressive forces and forces that would normally deform the flutes. In these circumstances, the board remains rigid. The food within a carton made of paperboard, typically of three or five ply, is protected from physical impacts during transportation. Yet, even with these advantages, condensation would form on the surfaces on the inside of this carton, making the food soggy on delivery.

Therefore, as these types of known cartons show, there is a need in the fast food industry, particularly those establishments that sell pizzas, for packaging that retains the heat of the hot food without unwanted water condensation forming within the carton, particularly on the underside of the lid.

Developments have been made to allow some of the steam out of such a carton. One such development is the provision of holes or slits on the sides, or near the edges, of the carton. However, for products such as pizzas, the hot air and steam from the center of the pizza cools the steam sufficiently to condense into water on the under surface of the lid above the food before the air and the steam reaches the holes. The holes and slits in the carton are not located directly above the food, which would allow the steam to escape quickly from the carton. The location of holes above the food could permit foreign objects and contaminants to fall on to the food. Furthermore, the use of such direct holes through the panels of the board reduces the strength of the board.

SUMMARY OF THE INVENTION

The object of the present invention is to provide a ventilation board and a ventilation system, that when used to make a panel defining an enclosed space, such as a carton, meets all three aforementioned aims demonstrated by the shortcomings of known fast food packaging. That is, to provide sufficient ventilation of the carton so that water condensed from food vapours does not run on to the food in the carton, and sufficient insulation so that the food in the carton is kept warm.

Further objects of the present invention are to provide a box made of this ventilation board, a flat-pack blank for making into such a box and a method of manufacturing ventilation board.

In accordance with a first aspect of the invention, there is a ventilation board made of multi-layer material, wherein the board comprises a layer provided with a first aperture; an adjacent layer provided with a second aperture, the first and second apertures being located relative to each other such that they are non-aligned and are substantially without overlap; a passageway interconnecting the first and second apertures to provide ventilation thereby permitting the passage of fluid therebetween and through the ventilation board, and an insulating passageway connecting with one of the apertures, thereby providing insulation by permitting passage of fluid along and into the insulating passageway. Advantageously, the board also acts as an insulator.

Advantageously, the ventilation board has an improved means of ventilation as it allows fluid, including air, to pass through the board, but prevents an object to pass through it.

Preferably, the apertures are adjacent to each other.

The interface between the layer and the adjacent layer may comprise at least one corrugated surface, whereby at least one of the corrugations in the surface, by way of its inherent shape and structure, defines the passageway providing ventilation and insulating passageway. Advantages of this configuration of a layer, or a part of the layer, in ventilation board include its high strength capability, its ability to absorb impacts, and that each corrugation within the board provides a ready-made component for making a passageway. Advantageously, these features are derivable from the inherent shape and structure of each corrugation.

At least one of the apertures is, preferably, defined by a first edge and a second edge, the first edge being a portion of the periphery of the surface of the layer in which the aperture is defined, and the second edge being a portion of an edge of the adjacent surface, thereby defining an open end of a corrugation. Advantageously, one of the apertures is formed on the edge of the board, using the natural configuration of the surfaces between the two layers, and the edges of these surfaces near their peripheries, to form this aperture.

The interface between the layer and the adjacent layer may comprise a laminar surface.

A ventilation board comprising a plurality of substantially parallel layers that includes the layer, the adjacent layer and one or more further-layers, each of the plurality of layers being adjacent to at least one other layer, the or each further-layer being provided with an aperture that is located relative to an aperture in the layer adjacent to the or each further-layer such that the two apertures are not aligned and are substantially without overlap; and a further passageway providing ventilation interconnecting these two said apertures permitting the passage of fluid therebetween and through the ventilation board. Advantageously, the board can have greater strength as the board comprises more than one layer, and the board, thus, comprises at least one intermediate layer.

In a second aspect of the invention, there is a ventilation board comprising a plurality of substantially parallel layers, each layer being adjacent to at least one other layer, each said layer being provided with an aperture that is located relative to an aperture in a layer adjacent to said layer such that these two apertures are not aligned and are substantially without overlap; and a passageway providing ventilation interconnecting said apertures permitting the passage of fluid there between and through the ventilation board. Advantageously, the board can have greater strength as the board comprises more than one layer, and the board, thus, comprises at least one intermediate layer.

The board may be such that the degree of ventilation is dependent upon the cross-sectional area of at least one of the apertures and of the passageway.

The board may be such that the degree of ventilation is dependent upon the displacement between the first and second apertures.

The board may be such that the degree of ventilation is dependent upon the cross-sectional shape of at least one of the apertures and the passageway.

The board may be such that the degree of ventilation is dependent upon the configuration of the passageway.

The board may be such that the degree of ventilation is dependent upon the relative orientation of the passageway to the rest of the board.

The board can further comprise an insulating passageway connecting with one of the apertures, thereby providing insulation by permitting passage of fluid along the insulating passageway. Advantageously, where there is a temperature difference between the layer and the adjacent layer, the passage of fluid along the insulating passageway and through the connecting aperture provides insulating properties to the ventilation board. Advantageously, the board also acts as an insulator, maintaining the temperature difference between the two layers and, thus either side of the board.

The board can be such that the degree of insulation provided by the board is dependent upon the physical shape and dimensions, and/or shape of the insulating passageway or the aperture connecting said passageway, or both. Advantageously, the degree of insulation provided by the board can be varied to suit the use of the board.

Preferably, the insulating passageway is at least one passageway. Advantageously, the board may have more than one insulating passageway and the connecting aperture could be connected to more than one insulating passageway.

At least one of the layer and the adjacent layer could be a single ply.

At least one of the layer and the adjacent layer can be a multi-ply layer, and wherein the aperture in each multiply layer is formed by an aperture in each ply in that layer and all of the apertures in the ply of one layer are substantially aligned.

Preferably the apertures are connected by at least a single passageway.

Each of the first aperture and the second aperture comprises at least one aperture. Advantageously, each of these apertures can be a single aperture or they can each be two or more apertures.

The passageway is, preferably, at least one passageway. Advantageously, each passageway can be a single passageway or a plurality of passageways.

A ventilation board, a ventilation box or a ventilation system may be made of at least one material including, in a non limiting list, paper, paper board, white paper, Kraft paper, duplex board, laminated paper, coated paper, butter paper, plastics material, high density polyethylene, low density polyethylene, polyethylene, polypropylene, polystyrene, poly carbonates, PET, PVC, glass, fiber, glass fiber, rubber, wood, timber, particle board, plywood, wood, laminates, veneer, metal, including metal sheeting, galvanized iron, aluminum, alloy, a ceramics material, cement, clay, earth, soil, asbestos sheets, sheets of wire or mesh, woven or non-woven fabrics, a compound material and in combination of said materials. Advantageously, the board is made of a single material or a combination of materials. Preferably, the board is made of paperboard. This material is suited, advantageously, for items such as disposable packaging due to its lightweight and low cost.

Preferably, the board is arranged to be used in microwave ovens, in refrigeration units, or both.

In a third aspect of the invention, there is a box having a panel comprising a ventilation board according to the first aspect of the invention. Advantageously, the board provides improved ventilation in the box and it can insulate the box to conserve the temperature difference between the inside and the outside of the box, making the board a useful material for fast food packaging. The box conserves heat within the box and ventilates the box, reducing the chance of hot food within the box from becoming soggy.

Preferably, the panel constitutes the top of the box. Advantageously, steam from within the box can be released directly into the atmosphere from within the box, even from apertures located directly above hot foods in the box, and there is little risk of anything being dropped from above, through the ventilation board, to contaminate the food.

The panel may constitute the base of the box. This, advantageously, improves the fluid circulation within the box, and, therefore, also the ventilation of the box. Furthermore, the steam from hot food can be released from the box from the underneath of the hot food without the risk of the food from falling out of the box.

The box may further comprise a foldable support located in, or positioned on the base, wherein the support has a first position for transporting the box, said support being folded in or against the surface of the box; and a second position for supporting the box above a surface, the support being folded out raising the base above the surface, thereby enhancing the ventilation of the box through the ventilation board in the base. Preferably the support comprises a plurality of legs.

The panel, preferably, constitutes a sidewall of the box. This, advantageously, allows the ventilation of the box through the side-panels of the box, which is useful, in particularly, for stacked boxes.

The box may have a fitment made of a panel of ventilation board according to the first aspect of the invention.

The fitment may be a compartmental wall, the compartmental wall permitting ventilation between compartments within the box.

Alternatively, the fitment can be a mat positioned within the box on the base of the box.

In a fourth aspect of the invention, there is a flat pack blank for folding into a box as according to the second aspect of the invention.

In a fifth aspect of the invention, there is a fitment for fitting to a box and for packing an article, which requires ventilation, the fitment comprising ventilation board according to the first aspect of the invention.

Preferably, the fitment is a mat for supporting an article, which requires ventilation under its underneath surface. Advantageously, as the mat rests on the ventilation board in the base and as the food rests on the mat, fluid can ventilate through the base. The fluid circulation within the box is thereby further improved, further preventing the food from becoming soggy.

In a sixth aspect of the invention, the ventilation board of the first aspect of the invention is arranged to be used in architectural applications, including, but not limited to, a roof, a partition, a door, a door panel, a window panel, an exterior wall, flooring, a dark room, a store, and the like. The architectural applications include providing walls of buildings and tents, permitting ventilation by way of the sides of the building or tent.

In a seventh aspect of the invention, the ventilation board of the first aspect of the invention is arranged to be used in articles including, but not limited to, a bag, a cover, a paper pouch, a paper utensil, a pot, a vase, a bucket, a coaster, a wrapper, a lid, an item of luggage, a shoe, a shoe sole, a cap, a helmet and the like.

In an eighth aspect of the invention, there is a ventilation system comprising a first aperture in a layer; a second aperture in an adjacent layer, the first and second apertures being located relative to each other so that they are non-aligned and are substantially without overlap, and a passageway interconnecting the first and second apertures thereby permitting the passage of fluid therebetween. Advantageously, the invention can be achieved by using a collection of interrelating components.

In a ninth aspect of the invention, there is a method of manufacturing a ventilation board, the ventilation board comprising at least two adjacent layers, the adjacent layers each having a surface in mutual contact, at least one of the surfaces being corrugated, the method comprising: providing an aperture in each layer; affixing the layers together such that the apertures in adjacent layers are non-aligned and are substantially without overlap defining a passageway between the surfaces of the adjacent layers thereby interconnecting the apertures; and permitting the passage of fluid through the board.

The steps of providing an aperture in each of the first and second layer may include the steps of: (1) defining an aperture in each layer; and (2) forming the aperture in each layer.

The step of forming the aperture in each layer can include the step of punching the layer.

The method can further comprise the step of selecting the extent of ventilation provided by the ventilation board.

The step of selecting the extent of ventilation can include selecting the cross-sectional area of the aperture in each layer.

The step of selecting the extent of ventilation may include selecting the displacement between the apertures in the adjacent layers or both.

The step of selecting the extent of ventilation could include selecting the configuration of the passageway.

The step selecting the extent of ventilation could include selecting the relative orientation of the passageway with respect to the rest of the board.

The steps of providing an aperture in each layer and of affixing the layers together, could further comprise the step of locating the apertures in the layers on affixing the adjacent layers together so that an insulating passageway is formed between the surfaces of the adjacent layers, the insulating passageway connecting one of the apertures and thereby permitting the passage of fluid along and into the insulating passageway and through the connecting aperture. Advantageously, where there is a temperature differential between the layer and the adjacent layer, the passage of fluid along the passageway and through the connecting aperture provides insulating properties to the ventilation board.

In a tenth aspect of the invention, there is a method of manufacturing a box having a side of a ventilation board according to first aspect of the invention.

In an eleventh aspect of the invention there is an insulating board, the board being made of multi-layer material, wherein the insulating board comprises a layer provided with an aperture; an adjacent layer; and an insulating passageway connected to the aperture, thereby permitting passage of fluid through the aperture along the passageway. Advantageously, when there is a temperature differential between the layer and the adjacent layer, the passage of fluid along the passageway and through the connecting aperture to provide insulating properties to the insulating board. Advantageously, the board also acts as an insulator, maintaining the temperature difference between the two layers and, thus, either side of the board.

DEFINITIONS

In this specification, the term "Carton" is used interchangeably with the term "Box", it being understood that a box has a broader meaning than a carton. Furthermore, the term box is used here to mean any one of a drum, a can, a container, a case, a pallet, a crate, a shipping container, and other containing devices.

A "Fitment" is a device that is used in packaging that is suitable for fitting to a box.

A "Panel" is a portion of ventilation board that makes, for example, a face of an article made of ventilation board, e.g. a box.

A "Ply" is a single sheet of material. It can be lamina or corrugated. As a lamina sheet it can be referred to as a top liner or a backing liner. A corrugated ply is also known as a corrugated liner or corrugated medium.

A "Layer" comprises at least one ply, so a layer can be multi-ply. A layer can be a single corrugated or laminar ply, a plurality of such ply or a combination of both to form a multi-ply layer. In a multi-ply layer of a ventilation board, all the apertures are aligned and between the adjacent layers, apertures are non-aligned. A layer has two surfaces. Adjacent layers have at least one corrugated surface at their interface (i.e. when they come into contact).

A "Multi-layer" is board that comprises a plurality of layers, i.e. it is a multi-layer material.

A "Fluid" includes gas, liquid and, therefore, steam, vapor and air.

A "Passageway" interconnects apertures in different layers, permitting the passage of fluid along the passageway between the apertures therebetween and through the board enabling the board to ventilate enclosed spaces. In the description, a "passageway" is also referred to as a "duct" or more specifically a "ventilation duct".

A "Duct", or ventilation duct is a type of passageway. It is a passageway that connects two apertures on either side of the board.

An "Insulating Passageway" is a passageway connecting an aperture on one side of the board, permitting fluid to pass through the aperture and along and into the insulating passageway and not allowing the fluid to pass through the board.

The "Configuration" of a passageway refers to the dimensional size of the passageway and the shape of the path of that passageway.

The "Orientation" of a passageway refers to the direction that a passageway has with respect to the other passageways in a layer, or a board within which the passageway is located. Therefore, the relative orientations of passageways within a board refers to the combination of the directions that the passageways have in that board, as well as the relative arrangement they have with respect to each other.

An "Architectural application" includes, in a non-limited list, a roof, a partition, a door, a door panel, a window panel, an exterior wall, a dark room, a store and the like An "Article" is an item made of the ventilation board for ventilation, including in a non-limited list, a bag, a cover, a paper pouch, a paper utensil, a pot, a vase, a bucket, a coaster, a lid, an item of luggage, a shoe sole, a shoe, a cap, a helmet, a microwave, a refrigerator and the like. Generally these items lie in fields other than in packaging and in architectural applications.

"Substantially" means, in relation to a feature in a claim to which the word "substantially" refers, immaterial variations to the feature which would, in the view of a man skilled in the art reading the specification, not affect the way in which the invention works.

A "System" is a group or combination of interrelated, independent, or interacting elements forming a collective entity.

The terms "First" and "Second" are used in the claims to differentiate two apertures. The word "adjacent" is, similarly used to differentiate layers. These words do not infer any properties that the apertures and layers might or might not have. In the description more appropriate terms are used more suited to the preferred embodiments of the invention therein described. Such terms include inner and outer, as these words infer direction. They are more suited for describing board used in, for example, a box.

BRIEF DESCRIPTION OF THE DRAWINGS

The embodiments of a ventilation board, a box comprising the ventilation board, a flat-pack blank for folding into a box made of ventilation board, a ventilation system made of the ventilation board and a method of making a ventilation board will now be described, by way of example only, with reference to the accompanying drawings, in which:

FIG. 1 shows a series of schematic drawings of conventional corrugated board in which:

1(A) shows a representation of two-ply corrugated board;

1(B) shows a representation of three-ply corrugated board; and

1(C) shows a representation of three-ply corrugated board with conventional direct ventilation through-holes;

FIG. 2 shows a series of schematic diagrams showing a ventilation duct in a panel of a box made of ventilation board according to the present invention, in which:

2(A) shows a top perspective view of a panel of ventilation board according to the present invention; and

2(B) shows a bottom perspective view of the panel of the ventilation board shown in FIG. 2(A).

Figure 4:
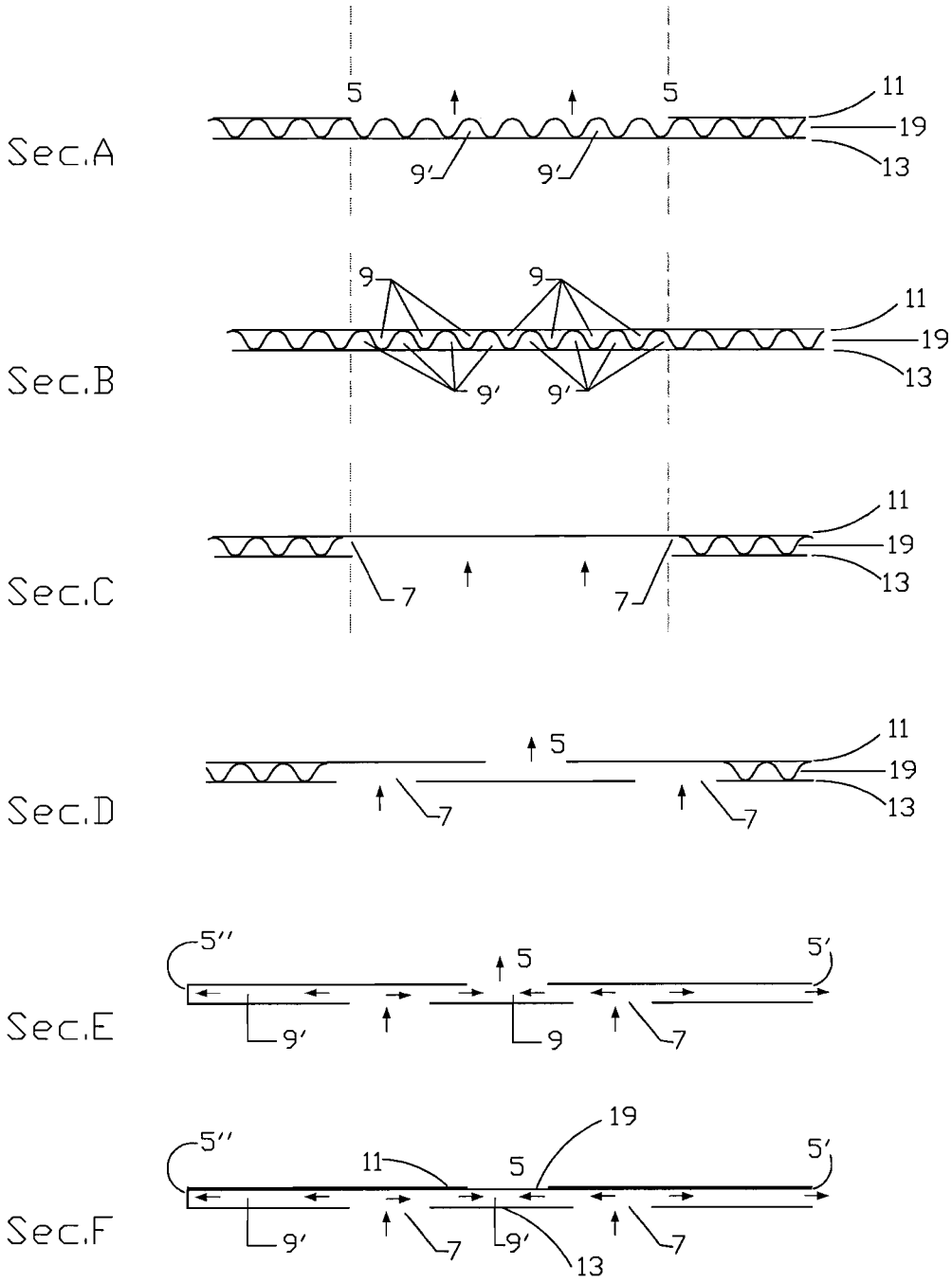
Figure 9:
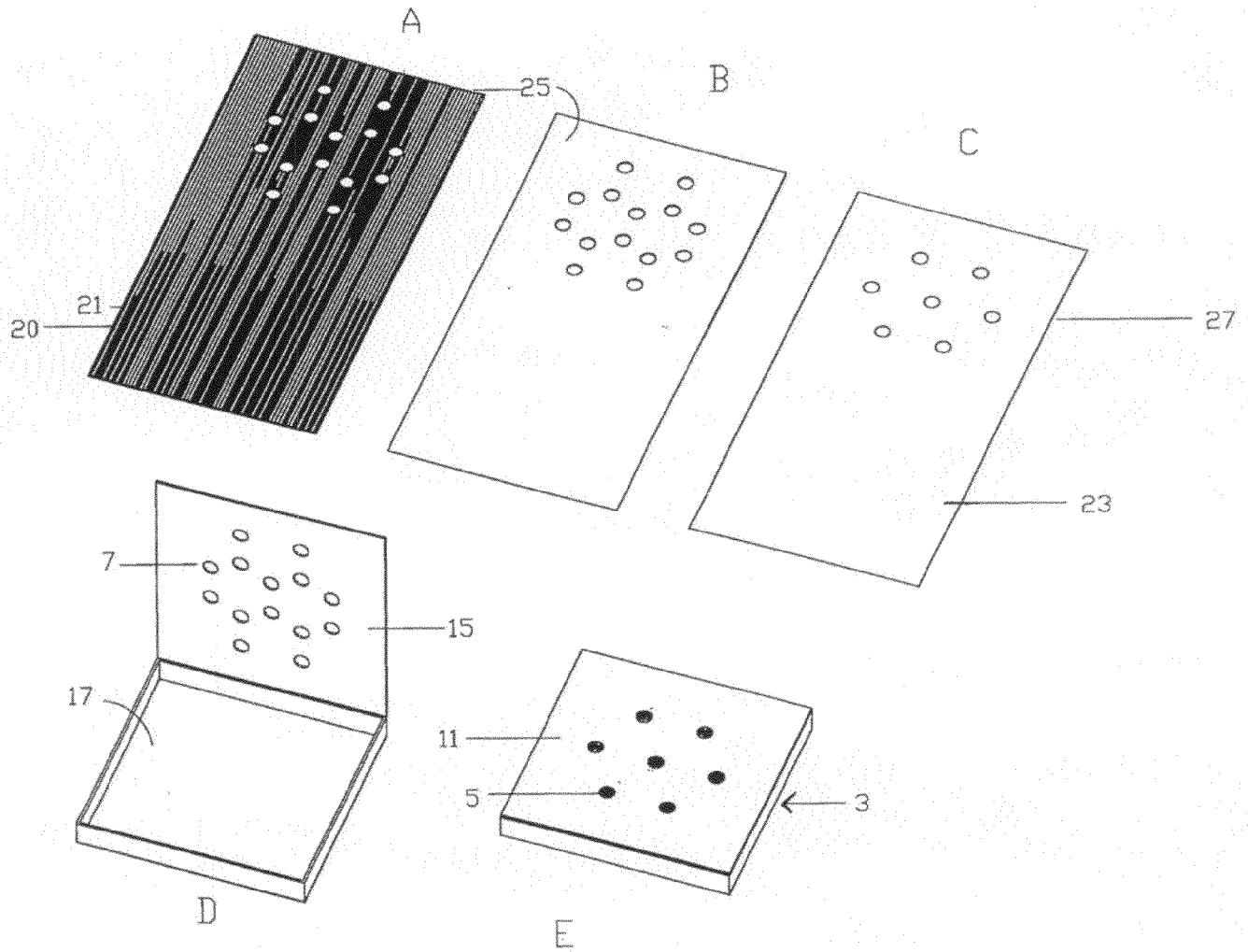

FIG. 3 shows a series of two diagrams (3A, 3B) showing a ventilation duct in a three-ply ventilation board made of corrugated board according to the present invention;

FIG. 4 shows a series of six diagrams (4A-4F) showing a cross-sectional view of a ventilation duct in a three-ply corrugated ventilation board according to the present invention;

FIG. 5 is a series of six diagrams, three of which (5A-5D) show two single ply layers making a ventilation board according to the present invention, each layer with at least one cut in one of the constituent layers, and three of which (5D, 5E1 and 5E2) shows a two-ply corrugated board with each single layer ply with at least one aperture;

FIG. 6 is a series of two schematic diagrams (6A, 6B) showing the manufacture of a three-ply panel of ventilation board according to the present invention having a ventilation duct and insulating passageway;

FIG. 7 is a series of six diagrams two of which (7A, 7B) show various arrangements of plies in a multi-ply ventilation board according to the present invention, and four diagrams (7C, 7D, 7E and 7F) show cross-sections of possible combinations of ventilation board showing a number of layers in specific configurations of the plies in the board;

FIG. 8 is a series of two schematic diagrams showing a blank for a box made of corrugated ventilation board according to the present invention, with a ventilation duct;

FIG. 9 shows a series of five schematic drawings of a box made of ventilation board according to the present invention with a plurality of ventilation ducts in its lid, during manufacture, in which:

9(A) shows a two-ply, punched, corrugated layer with the corrugations facing upwards;

9(B) shows the two-ply punched corrugated layer shown in FIG. 9A with the corrugations facing downwards;

9(C) shows a punched laminar layer;

9(D) shows a box made by affixing the laminar layer to the corrugated surface of the two-ply layer shown in FIGS. 9A, B and C, with the lid of the box open and parallel to the reverse panel of the box; and

Figure 10:
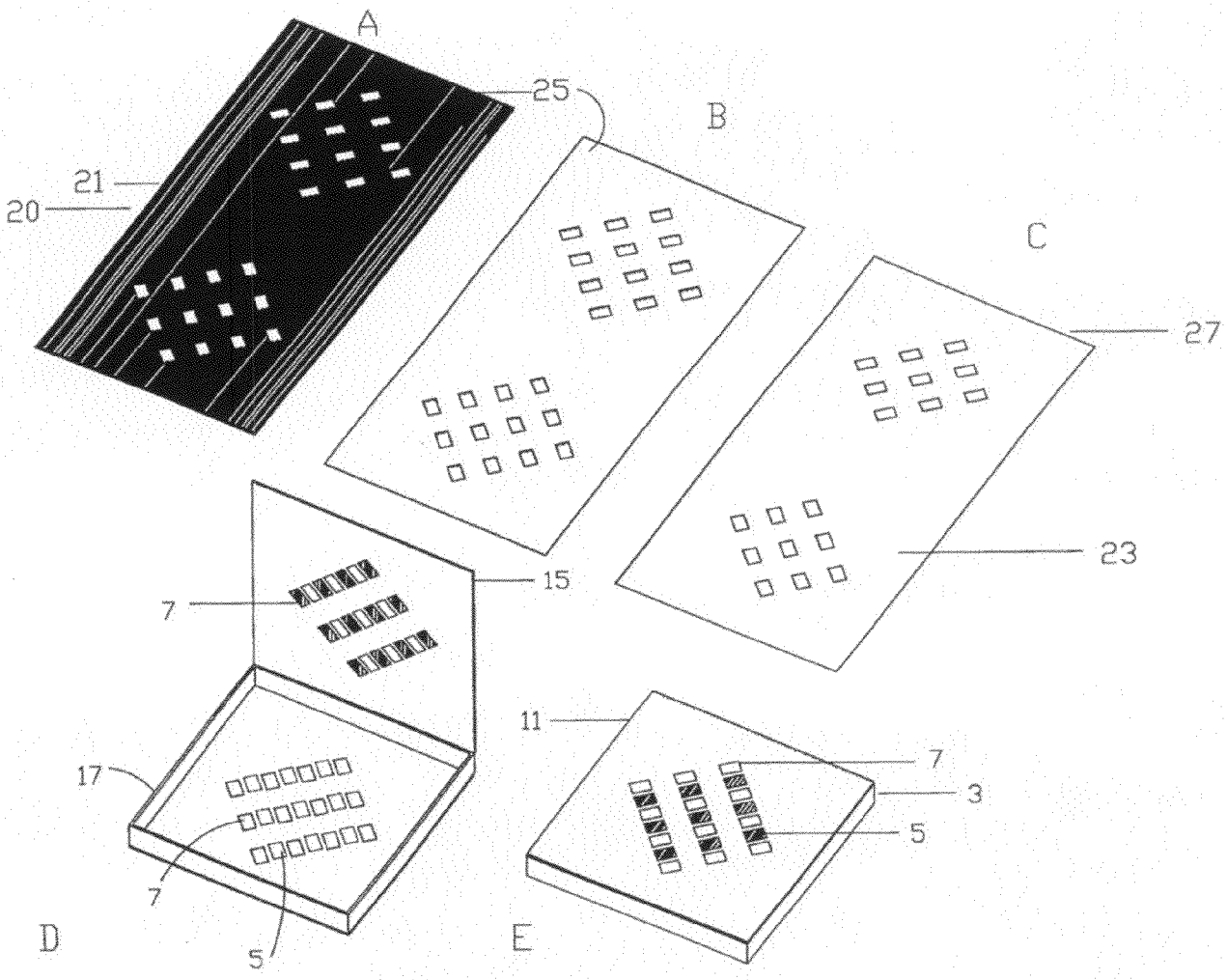

9(E) shows a view of the box in FIG. 9D with its lid closed;

FIG. 10 is a series of five schematic drawings showing a box according to the present invention during manufacture, the box having a plurality of simple ventilation ducts in its lid and its base, in which:

10(A) shows a two-ply, punched, corrugated layer with the corrugations facing upwards;

10(B) shows the two-ply punched corrugated layer of FIG. 10A with the corrugations facing downwards;

10(C) shows a punched, laminar layer;

10(D) shows a box made by affixing the laminar layer to the corrugated surface of the two-ply layer shown in FIGS. 10A, B and C, with the lid of the box open and parallel to the reverse side panel of the box; and

Figure 11:
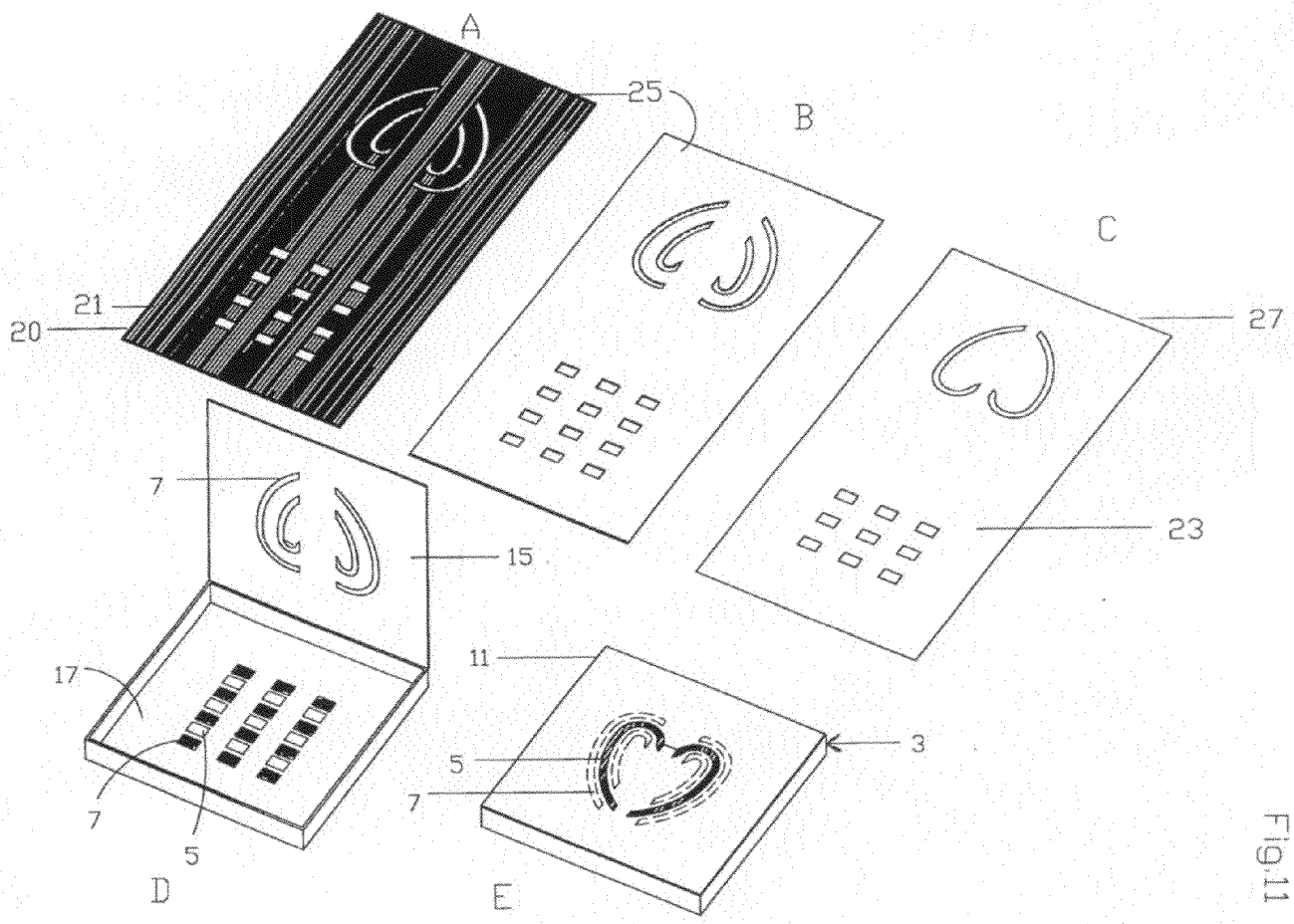

10(E) shows a view of the box in FIG. 10 with its lid closed;

FIG. 11 is a series of five schematic drawings according to the present invention showing a box made of ventilation board with a plurality of patterned ventilation ducts in its lid and its base, during manufacture in which:

11(A) shows a two-ply, punched layer with a corrugated surface, the corrugations facing upwards;

11(B) shows the two-ply, punched layer of FIG. 11A with the corrugations facing downwards;

11(C) shows a punched, single-ply plain laminar layer;

11(D) shows a box made by affixing the laminar layer to the corrugated surface of the two-ply layer shown in FIGS. 11A, B and C, with the lid of the box open and parallel to the reverse side of the box; and

Figure 12:
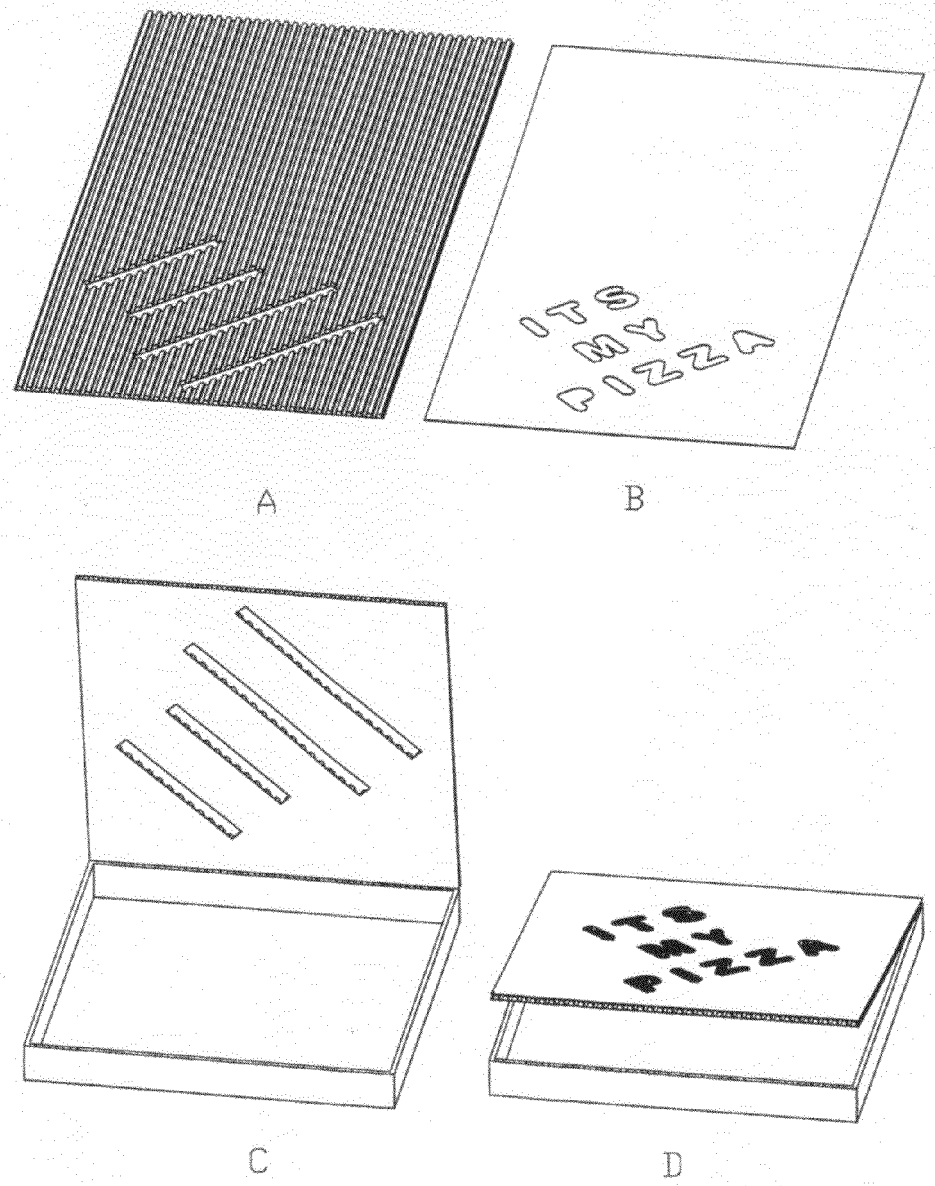
Figure 13:
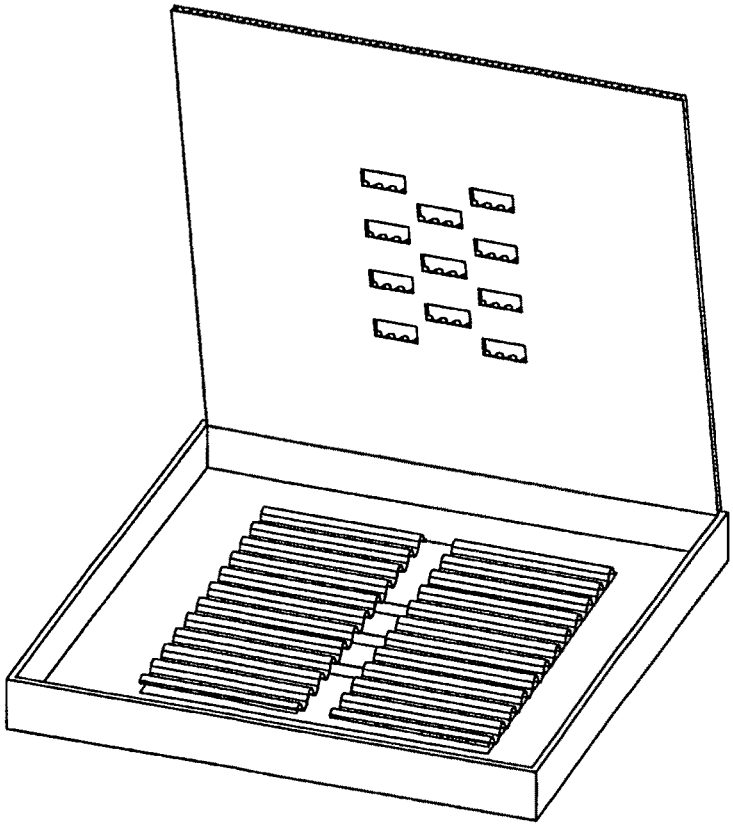

11(E) shows a view of the box in FIG. 11D with its lid closed;

FIG. 12 is a series of four schematic drawings (12A-12D) showing a box according to the present invention, like that shown in FIG. 11, with a plurality of patterned ventilation ducts in its lid; during manufacture; and FIG. 13 shows a box, as shown in FIG. 10 having a ventilation mat lying on the base of the box according to the present invention, the ventilating mat being made of ventilation board and comprising ventilation ducts.

DETAILED DESCRIPTION OF THE INVENTION

Referring to the drawings, by way of example to the structure of typical types of corrugated board, FIG. 1A shows corrugated board made of two-ply, having an inner layer 13 and a corrugated layer 19. FIG. 1B shows a three-ply corrugated board having an outer layer 11, a corrugated layer 19, and an inner layer 13. FIG. 1C shows a three-ply corrugated board having apertures 4 through all the layers of the board. This is a conventional feature used for ventilation of an enclosed space.

FIGS. 2A and 2B shows a top and bottom perspective view of panel 2 of a ventilation board for use in a box such as a carton 3 as shown in FIG. 9-13 for carrying hot food. The panel 2 is made of three-ply corrugated board comprising three layers: an outer layer 11, an inner layer 13, and a corrugated layer 19. The corrugated layer lies between the outer layer 11 and the inner layer 13. The ventilation duct 9 in the panel 2 comprises an outer aperture 5, an inner aperture 7, and a valley of the corrugation interconnecting the two apertures 5, 7 acting as a ventilation passageway. The insulating passageway 9' comprises the inner aperture 7 and hill of the corrugation acting as passageway which retains fluid along and into the insulating passageway 9'. The outer aperture 5 is defined by an aperture located in the outer layer 11 that defines the outer surface of the carton 3 as shown in FIG. 9-13. Likewise, the inner aperture 7 is defined by an aperture located in a layer that defines the inner surface of the carton 3 as shown in FIG. 9-13. In FIG. 2A, the inner aperture 7 also passes through the corrugated layer 19, but the outer aperture 5 does not. As can be seen from FIG. 2A, the apertures 5, 7 are non-aligned and are staggered, so that the apertures 5, 7 do not substantially overlap and yet they are adjacent to each other.

The ventilation board is located in the lid 15, or a top panel, of the carton 3 (shown in FIGS. 9 to 13). However, the ventilation board can be located in any panel of the box. Indeed, ventilation board can be located in both the base panel 17 and the lid panel 15 of the carton 3.

The material used to make the carton, in this preferred embodiment, is a multi-ply paperboard, which has at least one corrugated layer. In FIG. 2A the embodiment shown has three layers: a corrugated layer 19, of which one corrugation constitutes the passageway 9 and insulating passageway 9'; and two laminate layers that comprise respectively the outer layer 11 and the inner layer 13 of the carton 3 (shown in FIG. 9-13). It is possible to have more than one corrugation to define the passageway 9 connecting the two apertures 5,7 and the insulating passageway 9' connecting with aperture 7.

The carton 3 as shown in FIG. 9-13 is intended to store hot, carryout food during transportation of the food by protecting the food from damage that can occur through physical impact during transportation, by insulating the food, and by preventing condensation from steam forming on the interior surface of the box, the steam emanating from the food. Such condensation when it comes into contact or forms on the food makes the food soggy. Thus, as the aperture 7 of the ventilation board is located directly above the food in the carton 3, steam emanating from the food freely passes through the ventilation board to the atmosphere external to the carton 3. The steam does not condense on the inner surface of the inner layer 13 above the food. As the apertures 5, 7 are non-aligned, foreign objects cannot be dropped directly onto the food from the outside of the carton 3, thereby contaminating the food. Furthermore, as the path of the steam from inside the carton 3 to the outside is not direct, but passes between layers 11,13 of the multi-layer material, the ventilation board acts as a heat exchanger, retaining heat within the carton 3. This is achieved by the lengths of the passageway 9, and insulating passages 9', that connect with one of the apertures 5,7. These insulating passages 9' do not interconnect the apertures 5, 7.

The degree of ventilation of the carton 3 can be varied by a number of different parameters of the components of the passageway 9 and the ventilation board. These parameters include: the cross-sectional area of the apertures 5,7; the displacement between the apertures, and therefore also the length of the passageway 9 connecting the apertures 5,7; the shape of the apertures; the configuration of the passageway; the relative orientation of each passageway to the rest of the panel; the material (e.g. the type of paper) used to make the multi-layered material; the number of corrugations; the shape and cross-sectional size of the corrugations used to make the passageway; and the number of ventilation ducts in the carton 3 (as shown in FIGS. 9-13).

Similarly, the degree of insulation provided by the panel of ventilation board in the carton 3 can be varied by a number of different parameters of the ventilation board. These parameters include: the cross-sectional area and shape of the apertures 5,7; the shape, configuration and length of each insulating passageway 9'; the relative orientation of each passageway to the rest of the panel; the number of insulating passageways 9' connected to each aperture 5,7; the cross-sectional size of the corrugation used to make each insulating passageway 9'; and the number of ventilation ducts in the carton 3.

The preferred embodiment is a pizza box, which has a square base and a shallow depth. The width of the box is many times its height. In such a box, the distance between the sides and the edges from the center of the box is too great for effective ventilation to be provided by ventilation holes located only on the sides and edges of the box. The ventilation board can be used as the top panel of the box, enabling a ventilation duct to be located directly above the hot pizza. Of course, the ventilation board can be used for many other takeaway foods where the ventilation and insulation of the food are at issue.

The carton 3 can be used for items that require insulation and ventilation, such as for breathing. Such non-food items include agricultural products, such as poultry, and horticultural products, including flowers, fruit and salad vegetables and dairy products. The carton 3 can also be used in numerous other applications where ventilation is required, for example, in articles and architectural applications.

The steps of a method to make a panel of ventilation board is shown in FIG. 2A. In a first step of the method of manufacturing ventilation board, the board comprises two layers that are not joined to each other, for example a single-ply layer, the outer layer 11, and a two-ply-multi-ply layer, comprising the inner layer 13 and the corrugated layer 19. Note that to make the ventilation board, there is one corrugated surface 19 that is to be fixed to a laminar surface 11. These surfaces are of adjacent layers in the finished board. The two apertures 5,7 are then defined in each layer. Locations of these apertures are chosen so that, with respect to each other, on affixing the laminar layer 11 to the surface of the corrugated layer 19, the apertures are non-aligned and substantially without overlap, and the passageway 9 are defined between the surface of the corrugated layer 19 and the laminar layer 11. Preferably the apertures 5,7 are first defined and then formed, more preferably by punching. In the second step of the method, the adjacent layers are affixed together thereby forming the passageway 9 in the ventilation board.

FIG. 3A shows an exploded view of a ventilation duct in the panel of ventilation board made of three ply corrugated board. Line A-A bisects the outer aperture 5 in the outer layer. Line B-B bisects the passageways 9 interconnecting an inner aperture 7 to the outer aperture 5. Line C-C bisects the inner aperture 7. Line X-X bisects passageway 9 that interconnect the inner aperture 7 to a second outer aperture 5 and insulating passageway that is connected to aperture 7; and line Y-Y bisects the insulating passageways 9' in the panel. FIG. 3B is an enlarged perspective view of the panel between the cross-sections X-X and Y-Y showing the flow of fluid, as indicated by the arrows, in the corrugations within the panel. Line E-E (as shown in FIG. 3A) bisects the panel at the valley of the corrugation perpendicular to the cross-sections X-X and Y-Y and Line F-F bisects the panel at hill of the corrugation of the panel perpendicular to the cross sections X-X and Y-Y; and D-D bisects the panel diagonally. Like line E-E, line D-D bisects all three of the layers, the inlets, and the passageways.

FIG. 4A shows a series of cross-sectional views of this board along each of the lines A-A, B-B, C-C, D-D E-E and F-F that are shown in FIG. 3A. These cross-sectional views show the flow of fluid, as indicated by the arrows, relative to the passageways (9,9') and the outer and inner apertures 5,7. These diagrams help to demonstrate the teaching of the present invention of ventilation and insulation and, at the same time, the method of manufacturing a ventilation board disclosed herein.

In ventilation, the hot fluid moves through the ventilation duct in the ventilation board from the inner aperture 7 through the passageway 9 to the outer aperture 5 in layer 11 where it is released to the atmosphere. Cross-sectional C-C shows hot fluid entering into the passageway 9 and insulating passageway 9' through the inner aperture 7 in the inner layer 13. As shown in FIG. 3B and the cross-section B-B in FIG. 4, the fluid moves along the passageway 9 created by the troughs of the valley of the corrugated layer 19 and the outer laminar layer 11. As shown in cross-sectional E-E the fluid moves through the passageway 9 to the outer aperture 5 defined in the outer layer 11 where it escapes from the ventilation board as shown in cross-section A-A.

Also, as shown in cross-sectional E-E the fluid can move along and into the insulating passageway 9' away from the aperture 5, towards the ends of the board. The end of a board can be open to define an alternative opening 5'.

As shown in the cross-section F-F the fluid enters in the insulating passageway through the aperture 7 and move along and into the insulating passageway 9' and retain the fluid in the insulating passageway.

In insulation, hot fluid moves through the ventilation board from an inner aperture 7 into the insulating passageway 9', away from the outer aperture 5, as shown in cross-sectional view E-E and along and into the insulating passageway 9' as shown in cross-sectional view F-F. The heat from the fluid is not released into the atmosphere but is stored in the insulating passages 9' and is absorbed by the fabric of the material of the board. Where the fluid is humid, the fluid condenses as water within the insulating passageways 9'. Since water has very high specific heat capacity, the increase in the quantity of water in the insulating passageway 9' thereby increases the amount of heat that can be absorbed by the box. Incidentally, as the water is retained in the insulating passageways, it does not fall back on to the food, or other items, located beneath the ventilation board.

By this method, the insulating passages act to insulate the hot fluid on the inner side of the board from the cooler fluid on the other side of the board. Where the board would have open ends of its corrugations at the edge of the board, these can be closed to provide an occluded opening 5" and the passageway between these closed openings and the respective apertures 5,7 becomes an insulating passageway 9'. Therefore, condensation that forms within the enclosed "insulating passageway"9' remains in the passageway. Where the board is used to make a box for storage of food, the water condensation does not fall on the food. Heat is retained in the box and there is no, or little loss of water vapour.

Insulating passageways 9' can be defined as shown in FIGS. 3A and 3B between an inner layer 13 under the peaks of a corrugated layer 19 so the fluid is directed away from an inner aperture 7 towards an occluded opening 5" or towards another inner aperture as shown in FIG. 3A. Alternatively, they can be directed from an inner aperture 7 along and into the insulating passageway 9' towards an occluded opening 5", away from the outer aperture 5, along a passageway defined by the outer layer and the trough of the corrugated layer. Of course, if the outer aperture 5 passes through the corrugated layer instead of the inner aperture 7, the situation would be reversed: the passageway 9 interconnecting the inner aperture 7 with the outer aperture 5 would then pass between the peaks of the corrugated layer 19 and the adjacent surface of the inner layer 13.

The preferred method of manufacturing the ventilation board includes a technique of split layer punching. In this split layer technique, the layers of a board are punched separately before the layers are affixed together to make the board and, such that when these layers are affixed together, the apertures of adjacent layers do not overlap. However, the corrugations between the layers and within the layers of the board create indirect passageways between the apertures located in the inner most and outer most layers. Of course, some passageways in the board, once it is made, are connected only to one of these two apertures. Thus, the structures made by this technique have both insulating and ventilating properties.

Depending on the application of the panel 2, the position of the apparatus 5,7 can be adjusted to either the center area or can be distributed all over the board making a panel with any pattern or random configuration.

FIGS. 5A, B and C show how a simple ventilation duct can be built into a panel or ventilation board made of two-ply corrugated board. FIG. 5A shows a panel having an inner layer 13 with two slits that each function as the inner aperture 7 and a corrugated layer 19 in which the open ends of each corrugation act as an outer aperture. FIG. 5B is the reverse view of FIG. 5A. FIG. 5C shows an alternative embodiment of the ventilation means in a two-ply panel, where only the corrugated layer 19 is cut to have apertures. In this embodiment, the open inner end of each corrugation functions as an inner aperture 7 and each outer open end of each corrugation functions as an outer aperture 5. FIG. 5D shows a further variation of the embodiment shown in FIG. 5C. In this embodiment the inner layer has two strip apertures defining the inner apertures. FIGS. 5E (1) and 5E (2) show a further embodiment of a panel made of two-ply corrugated board having a ventilation duct created by non-linear punching to achieve a patterned surface. The two-ply corrugated board shown in FIGS. 5D and 5E can also each be used as a mat having ventilation means that can be placed under an item requiring ventilation underneath, for example, food to prevent it from becoming soggy.

FIG. 6A and FIG. 6B demonstrate steps involved in the method of manufacturing the ventilation board FIG. 6A shows schematically that the single and laminar ply of the outer layer 11, for example in a three-ply board, is punched separately from an inner layer comprising a laminar single-ply 13 and a corrugated ply 19. The inner layer is punched once, punching the laminar ply 13 and the corrugated ply 19 together. FIG. 6B shows how the two layers of the single-ply 11, in one layer, and the corrugated ply 19 and the second single laminar ply 13, in the other layer, are assembled together to form a panel of ventilation board having ventilation ducts and insulating passageway.

FIGS. 7A and 7B show various combinations and arrangements of a multi-ply layer comprising more than three plies, and possibly more than two layers, in a panel of corrugated board having at least one ventilation duct. These drawings also demonstrate possible arrangements of the layers of the board showing how the relative orientation of a passageway with respect to the rest of the board varies throughout the panel.

FIGS. 7C, D, E, and F show cross-sections of possible configurations of the passageway 9, in ventilation board comprising three or more plies. FIG. 7C shows a five-ply, but two-layered, ventilation board. There is only one passageway 9 interconnecting the two apertures 5,7. FIG. 7D shows a five-ply, three-layered, ventilation board. It has two interconnecting passageways 9, each passageway between different surfaces of the layers in the ventilation board. FIG. 7E shows a seven-ply, two-layered ventilation board. It only has one interconnecting passageway. FIG. 7F shows a seven-ply, four-layered ventilation board that has three passageways connecting the apertures 5,7.

If more than two layers are used, where each layer can comprise more than one ply, the apertures in the plies within a layer are aligned. The apertures between adjacent layers are non-aligned and are adjacent, but substantially without overlap. This permits the formation of a passageway 9 between adjacent layers. Where there are two or more passageways, the layers between the inner and outer layers are known as intermediate layers.

FIG. 8A shows one side of, and FIG. 8B shows the other side of, a series of ventilation ducts in corrugated ventilation board, in which the board is a flat-pack blank for making a box. The parts of the box are separated by scored lines. The blank can be folded along the scored lines to form the box.

FIGS. 9A to 9E show a carton 3 having at least one ventilation means 1, and a flat-pack blank template 20 for that carton. FIGS. 9A to 9E show the steps for manufacturing a carton 3 and its template 20 from a three-ply, paperboard material. The method relies on the securing of a layer 19 having a corrugated surface 21 to another layer 11 that could be corrugated but which, in the preferred embodiment, is flat.

In FIG. 9A, a two-ply layer 25, having an inner laminar ply 25 and a corrugated ply 21, is cut to shape and to have holes that define the inner aperture 7. FIG. 9B shows the other side of the layer, the flat, and laminar surface of the two-ply layer 25. A single-ply outer layer 27 is cut to the same size as the two-ply layer 25. Holes that define the outer aperture 5 are cut out of the single-ply outer layer. These apertures 5 are off set from the inner aperture 7. The single-ply outer layer 11 is then fixed to the two-ply layer 25, such as by pasting the single-ply outer layer to the corrugated surface of the two-ply layer. Thus the apertures 5,7 are proximate to each other without overlapping. On folding the flat-pack blank template 20 into a carton 3, the ventilation ducts are located in the lid 15 as shown in FIG. 9E.

This method can be used not just to create the apertures 5,7 that are circular in cross-section, but, as shown in FIGS. 10A to E and 11A to E, the apertures can have rectangular cross-sectional shape, or any other chosen shape. These figures also show that the apertures 5,7 can be located in the base 17 of the carton 3, as well as in the lid 15 as shown in FIG. 10E.

FIGS. 10A to C and 11A to C, show the steps of manufacturing two styles of cartons 3 each from a flat pack blank template 20. Each blank is made from a two ply layer 25 having a corrugated surface 21, as shown in FIGS. 10A and B, and a single ply layer 27 with a laminar surface 23, as shown in FIGS. 10C and 11C. The apertures 5, 7 are first punched in the two layers 27 and 25 respectively. The laminar surface 23 and the corrugated surface 21 are then affixed together to form the blank 20. The blank can then is made into form the cartons 3 as shown in the FIG. 10E.

Referring in particular to FIGS. 10D, 10E, 11D and 11E, which each show cartons 3 with ventilation ducts in both the lid 15 and the base 17, the carton can be modified for improved use with a pizza, by placing, on the base 17, a ventilation mat (not shown) made of ventilation board having the said ventilation duct. When this mat is placed above the area of the base 17 in which the ventilation ducts are located, the fluid circulation within the carton 3 improves. Consequently, more of the steam from the food is released to the atmosphere external to the carton 3, further reducing the quantity of condensed water falling on the food.

By raising the bottom base of the box through various inbuilt means the steam will also be released from the base. One such inbuilt mechanism is a foldable support that can be folded into or against the box during transportation of the box. When the box is placed down on a surface, the support can be folded out so the box rests on the surface by way of the support. The box is then raised above the surface permitting fluid to pass through the ventilation duct in the ventilation board comprising the base, thereby ventilating the box through the base. The supports of course can be one or more legs.

In a modification of the preferred embodiment, the corrugations need not have a sinusoidal cross-sectional shape, but can have a different cross-sectional shape. Thus, the layer could have corrugations that have a repeating series of regular or irregular cross-sectional shapes. The type, combination, and ply of the paper can each be varied to achieve different aesthetic and functional effects (e.g. the extent of ventilation). These modifications would be dependent on the final use of the carton 3, its design and intended appearance.

In a further modification the ventilation ducts could be located in the panels of the carton 3 not merely between the outer layer 11 and the inner layer 13 of the carton 3 but also in compartmental walls that divide the carton into a plurality of compartments (not shown).

In a further modification, the insulating passageway 9' can be made where the corrugations do not connect the inner aperture 7 to the outer aperture 5. Such a passageway 9' is created by flattening at least a part of a corrugation (not shown). This is a suitable way of forming the insulating passageways 9' and the occluded outlets 5".

It is intended that the panels used to make boxes, such as the carton described in the main embodiment, can be made of a variety of raw materials other than paper board, which includes (in a non limiting list) different types of white and Kraft paper (including duplex board, laminated paper, coated paper, butter paper, etc.), different types of plastics (such as high density polyethylene, low density polyethylene, polyethylene, polypropylene, polystyrene, polycarbonates) PET, PVC, glass, fiber, glass fiber, rubber, timber, particle board, plywood, wood, laminates, veneer, metal sheeting including galvanised iron or aluminum, alloys, ceramics, cement, clay, earth, soil, asbestos sheets, sheets of wire or mesh, woven or non-woven fabrics or combinations of these materials. The layers making up the plies of the ventilation board can be of all the same material or different materials in various combinations.

In a further modification, the passageways can be formed by fixing two corrugated layers together. They need not have their corrugations parallel or perpendicular to each other, but these are preferable embodiments.

The widths and shapes of the corrugations need not be similar, but these features too are preferable.

In a further modification, the ventilation board only provides the insulation as only one of the apertures 5,7 is formed. The passageway 9 connects with the apertures formed, thus enabling the board to function as an insulator as herein described, but without the ventilation feature.

In a further embodiment of the box made according to the invention is shown in FIG. 12. It is much like the boxes shown in FIGS. 9, 10 and 11, except the shape of the outer aperture 5 of the ventilation ducts are comprised of lettering.

Any of the boxes shown in FIGS. 10, 11 and 12 can be modified to be improved for use with hot food, by placing a multi-ply (e.g. two-ply) corrugated ventilation board above the inner aperture 7 in the bottom of the inner surface of the box, as shown in FIG. 13. Such fitment having the said ventilation duct will improve the fluid circulation within the box, allowing heat to be retained within the box, but steam and water to be dispersed outside the box.

The mat is a type of fitment or article that is used in packaging. Such fitments for a box also include compartmental dividers or compartmental walls.

Embodiments of a box made from ventilation board, as shown in the preferred embodiment, can be dimensioned for use in ovens, such as microwave ovens, and refrigerators. These embodiments can be made from materials that are suited for these uses, preferably cardboard.

Some embodiments of a box made from ventilation board, the passageways and the layers, in which the apertures are located, could be made from different elements that in combination inter-relate with each other to provide a ventilation system that functions in the same manner as the ventilation board described herein. For example, the passageway could be an open-ended cylinder lying between two layers, each with an aperture located adjacent to the different ends of the cylinder. Where the cylinder is not secured to the layers, the arrangement is a system, not a ventilation board. This same arrangement achieves the advantages as a ventilation board described herein.

The embodiments herein described are only intended to be examples of preferred embodiments of the invention. The description is intended to incorporate all variations and adaptations having the same results as the embodiments herein described.

The invention claimed is:

1. A ventilation board made of multi-layer material, wherein the board comprises:

a layer provided with a first aperture;

an adjacent layer, made of either a corrugated surface or a corrugated surface with a laminar surface, provided with a second aperture, wherein atleast one of the first aperture and the second aperture has a lateral dimension greater than the width of a corrugation of the corrugation surface; and the first aperture and the second aperture being located relative to each other such that the first aperture and the second aperture are vertically not aligned with each other and are substantially without overlap whereby the second aperture is substantially covered by the layer provided with the first aperture;

atleast one ventilation passageway interconnecting the first aperture and the second aperture to provide ventilation from one of the sides of the board to the other side of the board thereby permitting the passage of fluid therebetween and through the ventilation board; and a plurality of insulating passageways connecting with either one of the first aperture and the second aperture for providing insulation by permitting passage of fluid into and along the insulating passageways.

2. The ventilation board as claimed in claim 1, wherein atleast one of the corrugations of the corrugated surface defines atleast one ventilation passageway and the plurality of the insulating passageways.

3. The ventilation board as claimed in claim 1, wherein at least one of the apertures is defined by a first edge and a second edge, said first edge being a portion of the periphery of the surface of the layer in which the aperture is defined, and said second edge being a portion of an edge of the adjacent surface, thereby defining an open end of a corrugation.

4. The ventilation board as claimed in claim 1, wherein at least one of the layers comprises a laminar surface.

5. The ventilation board as claimed in claim 1, further comprising:

(1) a plurality of substantially parallel layers that includes the layer, adjacent layer and atleast one further-layers, each of the plurality of layers being adjacent to at least one other layer, each further-layer being provided with an aperture that is located relative to an aperture in the layer adjacent thereto such that the two apertures are not aligned and are substantially without overlap; and (2) a respective ventilation passageway interconnecting the apertures of each set of adjacent layers permitting the passage of fluid therebetween to thereby provide ventilation from one sides of the board to other.

6. The ventilation board as claimed in claim 1, wherein the board is configured and arranged such that the degree of ventilation through the board is dependent upon the physical dimensions, and/or shape, of each of the ventilation passageway and the first aperture and second aperture, thereby enabling the degree of ventilation to be varied to suit the intended use of the board.

7. The ventilation board as claimed in claim 1, wherein the board is configured and arranged such that the degree of ventilation is dependent upon the cross-sectional area of at least one of the first aperture and the second aperture and of the ventilation passageway.

8. The ventilation board as claimed in claim 1, wherein the board is configured and arranged such that the degree of ventilation is dependent upon the displacement between the first aperture and the second aperture.

9. The ventilation board as claimed in claim 1, wherein the board is configured and arranged such that the degree of ventilation is dependent upon the cross-sectional shape of at least one of the first aperture and the second aperture and the ventilation passageway.

10. The ventilation board as claimed in claim 1, wherein the board is configured and arranged such that the degree of ventilation is dependent upon the configuration of the ventilation passageway.

11. The ventilation board as claimed in claim 1, wherein the board is configured and arranged such that the degree of ventilation is dependent upon the relative orientation of the ventilation passageway to the rest of the board.

12. The ventilation board as claimed in claim 1, wherein the board is configured and arranged such that the degree of insulation provided by the board is dependent upon the physical dimensions, and/or shape, of the insulating passageway or the first aperture or the second aperture connected to said insulating passageway, or both.

13. The ventilation board as claimed in claim 1, wherein at least one of layers is a single ply.

14. The ventilation board as claimed in claim 1, wherein at least one of the layers is a multi-ply layer, and wherein an aperture is formed in each ply of the multi-ply layer and all of these apertures are substantially aligned.

15. The ventilation board as claimed in claim 1, wherein the layers includes a plurality of said first aperture and said second aperture.

16. The ventilation board as claimed in claim 1, wherein the board is constructed of at least one material including, in a non-limiting list, paper, paper board, white paper, Kraft paper, duplex board, laminated paper, coated paper, butter paper, a plastics material, high density polyethylene, low density polyethylene, polyethylene, polypropylene, polystyrene, poly carbonates, PET, PVC, glass, fibre, glass fibre, rubber, timber, particle board, plywood, wood, laminates, veneer, metal, including metal sheeting, galvanised iron, aluminium, alloy, a ceramics material, cement, clay, earth, soil, asbestos sheets, sheets of wire or mesh, woven or non-woven fabrics, a compound material or in combination thereof.

17. The ventilation board as claimed in claim 1, wherein the board is arranged to be used in microwave ovens, in refrigeration units, or both.

18. A box having a panel comprising a ventilation board as claimed in claim 1.

19. The box as claimed in claim 18, wherein the panel constitutes the top of the box.

20. The box as claimed in claim 18, wherein the panel constitutes the base of the box.

21. The box as claimed in any one of claim 18, wherein the panel constitutes a sidewall of the box.

22. A box having a fitment comprising a ventilation board as claimed in claim 1.

23. The box as claimed in claim 22, wherein the fitment is a compartmental wall, the compartmental wall permitting ventilation between compartments within the box.

24. The box as claimed in claim 22, wherein the box has a base and the fitment is a mat positioned within the box on the base.

25. A flat pack blank for folding into a box as claimed in claim 22.

26. The box as claimed in claim 18, further comprising a foldable support having a first position for transporting the box and a second position for supporting the box above a surface, said support being folded into or against a surface of the box.

27. A fitment for fitting to a box and for packing an article, said fitment comprising ventilation board as claimed in claim 1.

28. The fitment as claimed in claim 27, wherein the fitment is a mat for supporting an article, requiring ventilation there underneath.

29. The ventilation board as claimed in claim 1, wherein said board is arranged to be used (a) in architectural applications, including, but not limited to, a roof, a partition, a door, a door panel, a window panel, an exterior wall, flooring, a dark room, a store, and the like (b) in articles including, but not limited to, a bag, a cover, a paper pouch, a paper utensil, a pot, a vase, a bucket, a coaster, a wrapper, a lid, an item of luggage, a shoe, a shoe sole, a cap, a helmet and the like or (c) to store foods as well as non-food items include agricultural products, such as poultry, and horticultural products, including flowers, fruit and salad vegetables and dairy products.

30. The ventilation board as claimed in claim 1, wherein both the first aperture and the second aperture have a lateral dimension greater than the width of a corrugation of the corrugated surface.

31. A ventilation system comprises:

a. a first layer provided with a first aperture;

b. a second layer, made of either a corrugated surface or includes a corrugated surface with a laminar surface, provided with a second aperture, wherein atleast one of the first aperture and the second aperture has a lateral dimension greater than the width of a corrugation of the corrugation surface; and the first layer and second layer being located relative to each other such that the first aperture and second aperture are vertically not aligned with each other and are substantially without overlap whereby the second aperture is substantially covered by the first layer with the first aperture;

c. atleast one ventilation passageway interconnecting the first aperture and the second aperture to provide ventilation from one side of the system to the other side of the system thereby permitting the passage of fluid therebetween; and d. a plurality of insulating passageways connecting with either one of the first aperture and the second aperture but not both the first aperture and the second aperture, for providing insulation by permitting passage of fluid into and along the insulating passageway.

32. A ventilation board made of multi-layer material, wherein the board comprises:

a first layer provided with a first aperture;

a second layer, made of either a corrugated surface or includes a corrugated surface with a laminar surface, provided with a second aperture, wherein atleast one of the first aperture and the second aperture has a lateral dimension greater than the width of a corrugation of the corrugation surface; and the first layer and the second layer being located relative to each other such that the first aperture and the second aperture are vertically not aligned with each other and are substantially without overlap whereby the second aperture is substantially covered by the first layer with the first aperture;

a ventilation passageway interconnecting the first aperture and the second aperture permitting the passage of fluid therebetween to thereby provide ventilation through the board; and a plurality of insulating passageways connected to the first aperture and the second aperture, wherein each insulating passageway is connected to either one of the first aperture and the second aperture, but not both the first aperture and second aperture, thereby providing insulation by permitting passage of fluid into and along the insulating passageway.

33. The ventilation board as claimed in claim 32, comprising a third layer provided with a third aperture and having a lateral dimension substantially equal to or greater than the width of a corrugation of the corrugation surface, said second and third apertures being located relative to each other such that they are vertically non-aligned and are substantially without overlap, and a ventilation passageway interconnecting the second aperture and the third aperture permitting the passage of fluid therebetween thereby provide ventilation through the board.

34. A ventilation board made of multi-layer material, wherein the board comprises:

a multiplicity of layers arranged in a stack with each layer having at least one adjacent layer, made of either a corrugated surface or includes a corrugated surface with a laminar surface, each said layer having an aperture having a lateral dimension greater than the width of a corrugation of the corrugation surface, therethrough, said layers being arranged such that each aperture in a layer is located vertically not aligned with and in a substantially non-overlapping relationship relative to the aperture of an adjacent layer;

atleast one ventilation passageway interconnecting the apertures of a pair of adjacent layers permitting the passage of fluid therebetween to thereby provide ventilation through the board; and a plurality of insulating passageways connected to each aperture, wherein each insulating passageway is connected to either one of the apertures disposed on a pair of adjacent layers, but not both the apertures disposed on a pair of adjacent layers, thereby providing insulation by permitting passage of fluid into and along the insulating passageway.

* * * * *